US008398371B1

(12) United States Patent
Liang

(10) Patent No.: US 8,398,371 B1
(45) Date of Patent: Mar. 19, 2013

(54) TURBINE BLADE WITH MULTIPLE NEAR WALL SERPENTINE FLOW COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 513 days.

(21) Appl. No.: 12/834,209

(22) Filed: Jul. 12, 2010

(51) Int. Cl.
*F01D 5/18* (2006.01)

(52) U.S. Cl. ..... 416/97 R

(58) Field of Classification Search ..... 416/97 R
See application file for complete search history.

(56) References Cited

FOREIGN PATENT DOCUMENTS

JP 60198305 A * 10/1985

* cited by examiner

*Primary Examiner* — Richard Edgar
(74) *Attorney, Agent, or Firm* — John Ryznic

(57) ABSTRACT

A large and highly twisted and tapered turbine rotor blade with a low flow cooling circuit that includes a first serpentine flow circuit in a forward section of the lower span of the blade, a second serpentine cooling circuit in the aft region of the lower span, a third serpentine cooling circuit in the forward region of the upper span, and a fourth serpentine cooling circuit in the aft region of the upper span to provide cooling for the entire blade. Cooling air from the first serpentine flows into the third serpentine cooling circuit and cooling air from the second serpentine flows into the fourth serpentine cooling circuit so that the lower span of the blade is cooled first using fresh and relatively cooler cooling air.

13 Claims, 4 Drawing Sheets

TURBINE BLADE WITH MULTIPLE NEAR WALL SERPENTINE FLOW COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically for an air cooled large highly twisted and tapered turbine blade for an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A heavy duty large frame industrial gas turbine (IGT) engine is a very large engine with large turbine rotor blades. Current IGT engines include cooling for typically the first and second stage turbine vanes and blades. The later stage airfoils (vanes and blades) in the turbine do not require cooling because the hot gas stream temperature has dropped well below the melting temperatures of these airfoils. However, future IGT engines will have higher turbine inlet temperatures in which the third and even the fourth stage turbine rotor blades will require cooling in order to prevent significant creep damage. These hot turbine blades are under very high stress loads from rotating within the engine and therefore tend to creep of stretch from long period of operation. Creep issues are especially important for the lower sections of the blades because the lower section not only must provide structural support for the lower section of the blade but also for the upper section of the blade. Thus, internal cooling circuitry will be required in these blades.

Because of the increased spanwise length of these larger turbine rotor blades, the blade have a very high level of twist and taper for aerodynamic reasons. One prior art method of cooling a large turbine rotor blade is shown in U.S. Pat. No. 6,910,864 issued to Tomberg on Jun. 28, 2005 and entitled Turbine bucket airfoil cooling hole location, style and configuration. The cooling circuit for this blade includes drilling radial holes into the blade from the tip to the root. Limitations of drilling long radial holes from both ends of the airfoil section of the blade increases for a large highly twisted and tapered blade airfoil because the radial holes will not line up from the root to the tip. A reduction of the available cross sectional area for drilling radial holes is a function of the blade twist and taper. Higher airfoil twist and taper yield a lower available cross sectional area for drilling radial cooling holes. Cooling of the large, highly twisted and tapered blade by this process will not achieve the optimum blade cooling effectiveness required for future low flow cooling engines. It is also especially difficult to achieve effective cooling for the airfoil leading and trailing edges. Thus prevents higher turbine inlet temperatures for a large rotor blade cooling design that uses drilled radial cooling holes.

BRIEF SUMMARY OF THE INVENTION

A large IGT engine turbine blade with a large amount of twist and taper can be effectively cooled with the cooling circuit of the present invention that includes a blade lower span cooling circuit and a blade upper span cooling circuit in series. A triple pass inward flowing serpentine circuit is used for the blade lower span flow circuit with trip strips to augment the cooling side internal heat transfer coefficient. The cooling cavity is oriented in the chordwise direction to form a high aspect ratio formation. Cooling air is fed through the airfoil leading edge and trailing edge first to provide low metal temperature and a higher HCF (high cycle fatigue) requirement for the leading and trailing edge root sections. The tall blade is partitioned into two half sections in which the lower half is cooled first to minimize the heating up of the cooling air and yield an improved creep capability for the blade.

An outward flowing triple pass serpentine circuit is used for the blade upper span. The inlet for the upper span serpentine circuit is connected to the exit of the lower span serpentine flow circuit. Although the cooling air is used for the cooling of the blade lower span first, the use of the cooling air first in the lower span and then in the upper span will provide for a balanced blade cooling design. The triple pass serpentine flow circuit is finally discharged through the airfoil leading and trailing edges at the end of the serpentine circuits. Trip strips are used tin the outward flowing serpentine flow channels to enhance the internal heat transfer performance.

DETAILED DESCRIPTION OF THE INVENTION

A turbine blade for a gas turbine engine, especially for a large frame heavy duty industrial gas turbine engine, is shown in FIGS. 1 through 4 and is for use in a large rotor blade that has a large amount of twist and taper. The blade cooling circuit is divided up into a lower span cooling circuit and an upper span cooling circuit so that the low span is cooled first with fresh cooling air before using the same but then heated cooling air to cool the upper span. Each cooling circuit also includes channels or passages that flow along the pressure side of the airfoil and then along the suction side so that both sides are cooled.

Figure 1:
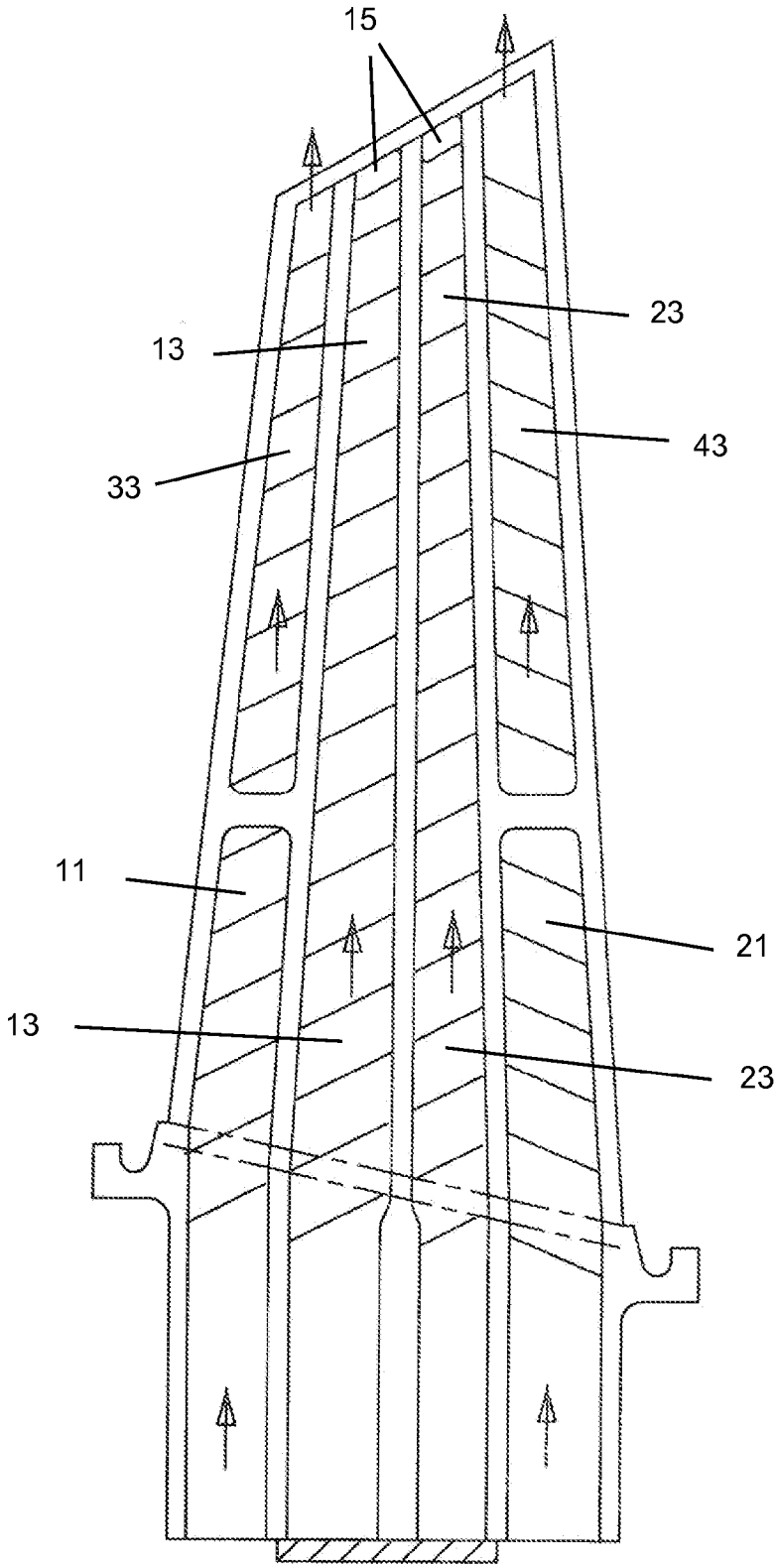
FIG. 1 shows a cross section profile view of the blade cooling circuit on the pressure side for the present invention.
Figure 3:
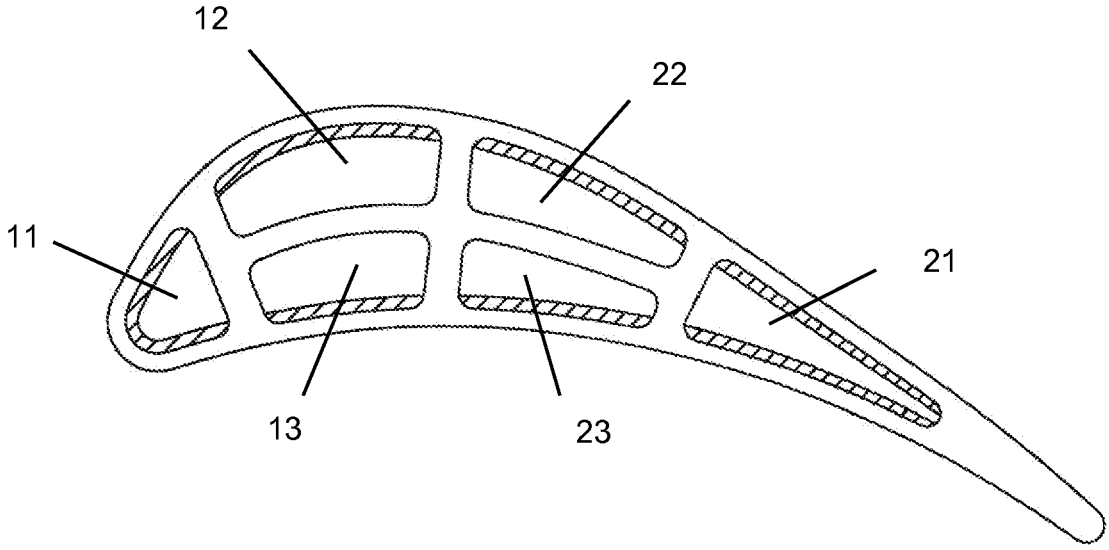
FIG. 3 shows a cross section view of the blade cooling circuit in a plane perpendicular to the spanwise direction of the blade of the present invention.

FIG. 1 shows a profile view of the cooling circuit along the pressure side of the blade and includes a leading edge cooling channel 11 that provides cooling for the leading edge region of the blade in the lower span and a trailing edge cooling channel 21 that provides cooling for the trailing edge region of the blade in the lower span. FIG. 3 shows the leading edge cooling channel 11 and the trailing edge cooling channel 21 is a different view. The leading edge cooling channel 11 and the trailing edge cooling channel 21 form the cooling air supply channels for the blade cooling circuit and further described below.

Figure 2:
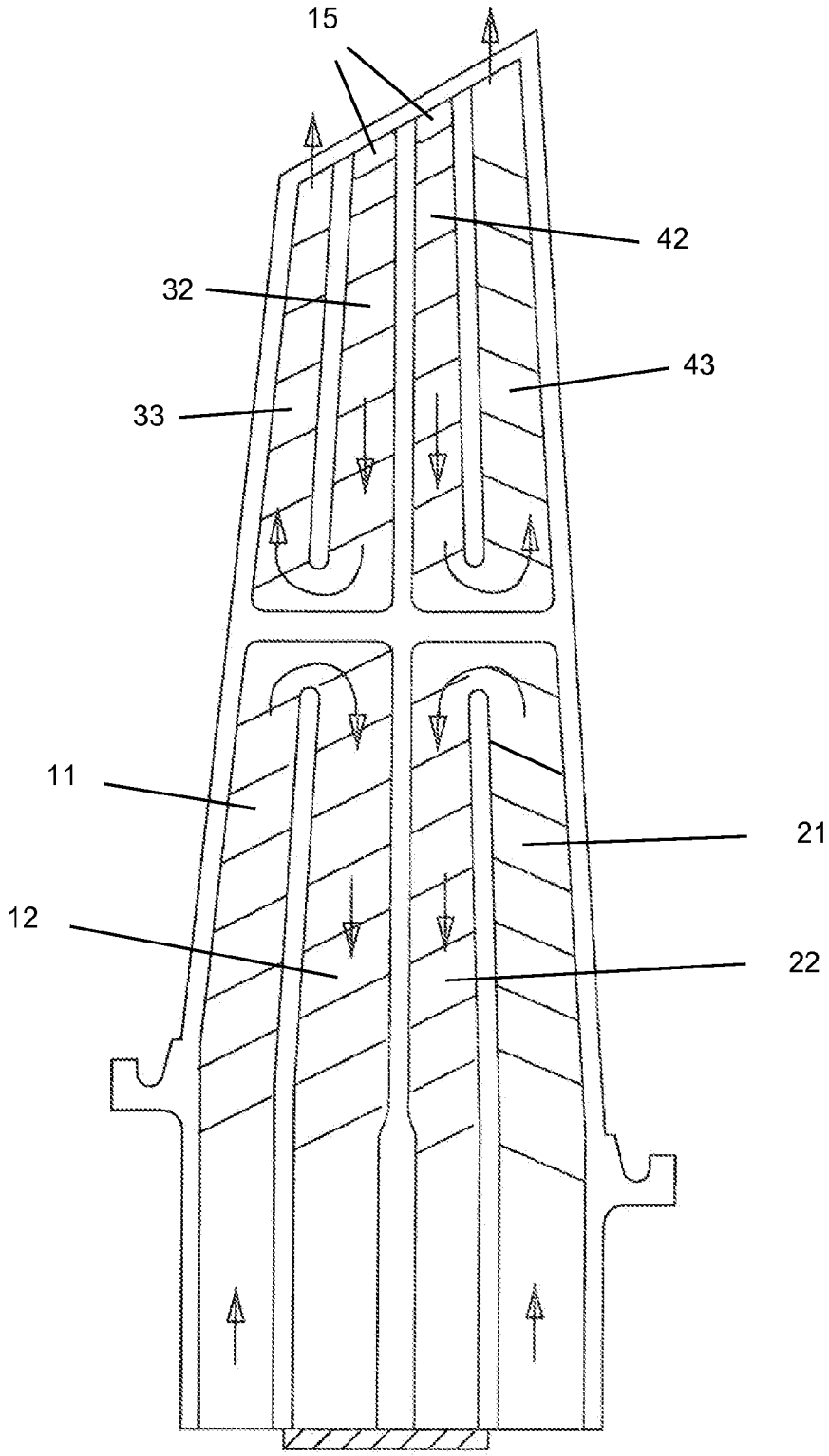
FIG. 2 shows a cross section profile view of the blade cooling circuit on the suction side for the present invention.

As seen in FIG. 2, the leading edge cooling channel 11 flow up and then turns down to flow into a second leg or channel 12 that is located only on the suction side wall of the blade in the lower span. The second leg 12 then turns and flow up into a third leg or channel 13 that is located on the pressure side wall parallel to and adjacent to the second leg 12. FIG. 3 shows another view of the three legs 11-13 that form a triple pass serpentine flow cooling circuit to cool the leading edge and the forward section of the airfoil in the lower span of the blade. Two cross-over channels 15 located at the ends of channels 13 and 23 connect to the other side of the blade at the tip so that the cooling air flows to the next serpentine flow circuits.

As seen in FIG. 1, the third leg 13 extends from the root to the tip of the blade, extending into the upper span of the blade to form a first leg of another triple pass serpentine flow circuit that will cool the forward section of the blade in the upper span. The upper span channel 13 turns and then flow downward into a second leg 32 as seen in FIG. 2 and then into a third leg 33 that is located along the leading edge region in the upper span of the blade. The upper span channel 13 is located on the pressure wall side with the second leg 32 located on the suction wall side and adjacent to the upper span channel 13. This would be equivalent to the channels 12 and 13 shown in FIG. 3.

Thus, the forward half of the blade is cooled with two triple pass serpentine flow cooling circuits in which the lower span is cooled first and then the upper span is cooled after using the same cooling air flow. The serpentine circuits flow along the pressure side wall and then the suction side wall in the middle region. Both cooling circuits begin and end with a cooling channel located along the leading edge region.

The aft section of aft half of the blade is also cooled with a similar circuit as the forward half described above. The trailing edge channel 21 located along the trailing edge in the lower span of the blade is the cooling supply channel for the aft half of the blade and flows up and turns into a second leg 22 located along the suction wall side as seen in FIG. 2, which then turns and flows upward in a third leg 23 as seen in FIG. 1. This third leg 23 extends up and into the upper span of the blade just like the third leg 13 that cools the forward half of the blade. The third leg 23 then turns and flows downward into the second leg 42 as seen in FIG. 2 to cool the suction side wall along the upper span. The second leg 42 flows downward and turns into a third leg 43 located along the trailing edge region in the upper span of the blade.

Figure 4:
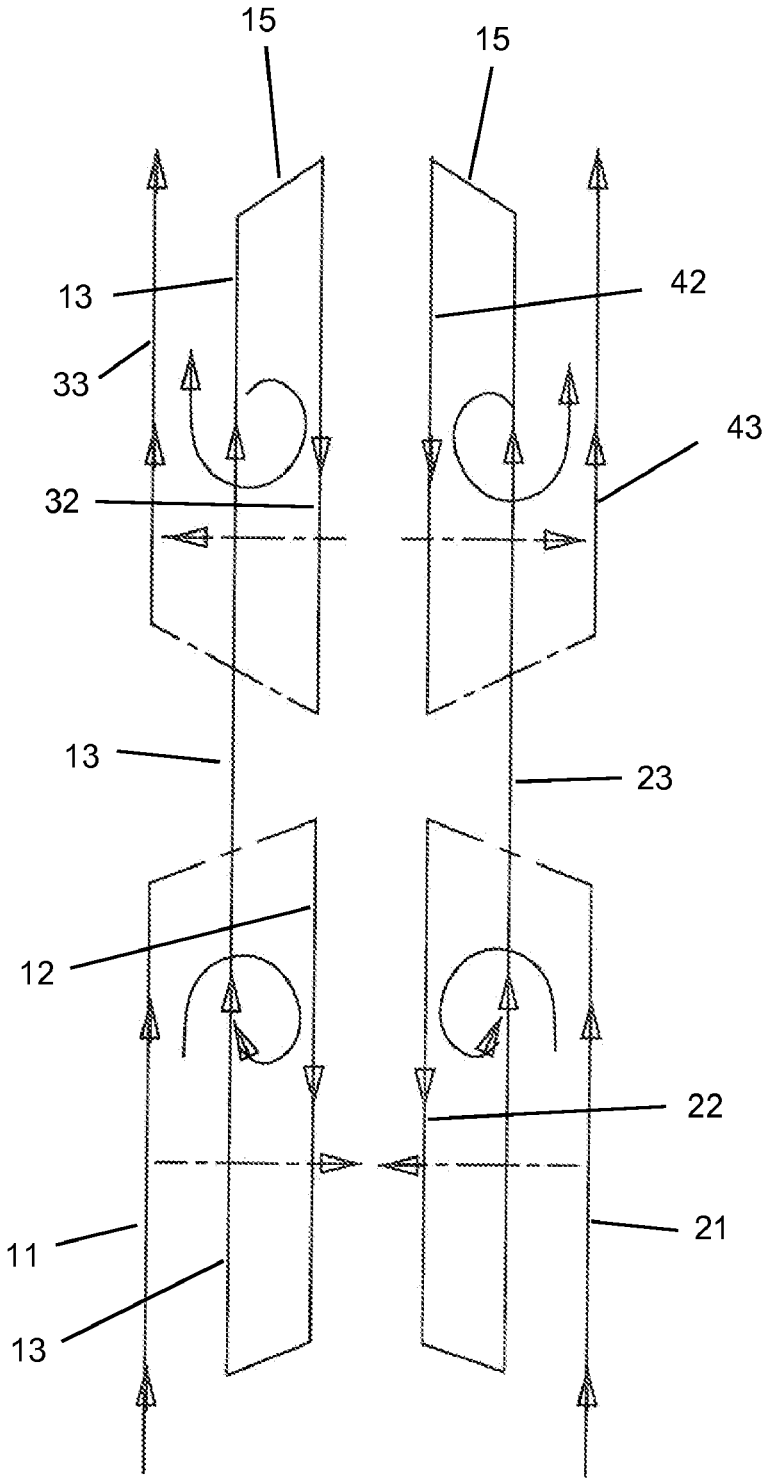
FIG. 4 shows a flow diagram for the cooling circuit of the blade of the present invention.

FIG. 4 shows a complete flow diagram for the blade cooling circuit that includes both the lower span and the upper span. For cooling the forward half of the blade, cooling air flows from an outside source and into the channel 11 located along the leading edge, then turns into the second leg 12 located along the suction side wall but only in the lower span, and then turns into the third leg 13 that is located along the pressure wall side and flows up and into the upper span. The location of the dividing line between the lower span and the upper span can be changed depending upon factors such as cooling requirements for the lower span. The third leg 13 flows up and into the upper span and then flows down along the leg 32 located on the suction wall side in the upper span, and then into the third leg 33 located along the leading edge region in the upper span of the blade. The cooling air from the third leg 33 is then discharged out through tip cooling hole or holes to provide cooling for the blade tip and an optional squealer pocket if used.

FIG. 4 also shows the aft half of the blade cooling circuit and begins with the trailing edge cooling channel 21 in the lower span that is supplied with cooling air from the external source. The T/E leg or channel 21 turns and flows into the second leg 22 located along the suction side wall in the lower span, and then turns and flows up and into the third leg 23 that extends into the upper span and along the pressure side wall. The third leg 23 turns at the blade tip and flows downward into the second leg 42 located along the suction wall side of the blade in the upper span, and then turns and flows upward into the third leg 43 that is located along the trailing edge region in the upper span. The cooling air from the third leg 43 then flows through a blade tip cooling hole or holes in the tip to provide cooling for the blade tip and the squealer pocket if used.

Thus, the cooling circuit of the present invention can be used in a blade that requires low flows, and can be used in a blade with a large amount of twist and taper because the cooling circuit can be easily cast using the lost wax or investment casting process. Also, the low span of the blade is cooled first with the fresh (relatively cooler air) before the upper span is cooled. The lower span is more susceptible to creep because the lower span must also support the high tensile stress from the upper span mass of the blade. The cooling circuit will also minimize the airfoil rotational effects for the cooling channel internal heat transfer coefficient. The cooling circuit achieves a better airfoil internal cooling performance for a given cooling air supply pressure and flow level. The cooling circuit works extremely well in a blade cooling design with a low cooling air flow application.

Major advantages of this cooling circuit over the prior art drilled radial cooling holes design are described below. The cooling circuit of the present invention partitions the blade into two half (forward half and aft half) to allow for the use of the dual serpentine flow cooling circuits and without re-circulated heated cooling air from the upper span of the blade. This yields a better creep capability for the lower span of the blade. The serpentine flow cooling circuit yields higher cooling effectiveness level than the straight radial cooling holes design. The triple pass serpentine flow cooling design yields a lower and more uniform blade sectional mass average temperature for the lower span of the blade which improves the blade creep life capability. The inward flowing serpentine cooling circuit with leading edge and trailing edge cooling air supply provides cooler cooling air for the blade root section and thus improves the airfoil high cycle fatigue (HCF) capability. The outward serpentine flow cooling design with cooling air channel from the airfoil mid-chord section improves the airfoil creep capability and allows for a higher operating temperature for future engine upgrades. The use of the cooling air for cooling of the lower span of the blade first and then cooling the upper span is inline with the blade allowable metal temperature profile. The high aspect ratio serpentine flow cooling channels provides better cooling for the airfoil design. The spiral serpentine flow channels minimize the impact of cooling channel internal HTC (heat transfer coefficient) due to airfoil rotational effect. The spiral serpentine flow channels in the partitioned airfoil is in the spanwise direction. the current spanwise spiral serpentine flow circuit can be expanded into a triple spanwise spiral serpentine flow circuit by also including a mid-chord triple pass serpentine flow cooling circuit similar to the L/E and T/E serpentine flow cooling circuits to further divide the blade into three section that include the L/E section, the T/E section and a mid-chord section between the two edge sections.

I claim the following:

1. An air cooled turbine rotor blade comprising:

a leading edge and a trailing edge with a pressure side wall and a suction side wall extending between the two edges;

the blade having an airfoil with a lower span and an upper span;

a first multiple pass serpentine flow cooling circuit located in the lower span and in a forward section of the airfoil;

a second multiple pass serpentine flow cooling circuit located in the lower span and in an aft section of the airfoil;

a third multiple pass serpentine flow cooling circuit located in the upper span and in a forward section of the airfoil;

a fourth multiple pass serpentine flow cooling circuit located in the upper span and in an aft section of the airfoil;

the third multiple pass serpentine flow cooling circuit being supplied with the cooling air from the first multiple pass serpentine flow cooling circuit; and, the fourth multiple pass serpentine flow cooling circuit being supplied with the cooling air from the second multiple pass serpentine flow cooling circuit.

2. The air cooled turbine rotor blade of claim 1, and further comprising:

each of the four multiple pass serpentine flow cooling circuits are triple pass serpentine circuits.

3. The air cooled turbine rotor blade of claim 2, and further comprising:

the second legs of the four multiple pass serpentine flow cooling circuits extend along the suction side wall of the blade.

4. The air cooled turbine rotor blade of claim 2, and further comprising:

the third legs of the two lower span serpentine flow circuits and the first legs of the upper span serpentine flow circuits form a common cooling channel that extends from the blade root to the blade tip and along the pressure side wall of the airfoil.

5. The air cooled turbine rotor blade of claim 2, and further comprising:

the first leg of the first serpentine flow circuit is located along the leading edge region of the airfoil; and, the first leg of the second serpentine flow circuit is located along the trailing edge region of the airfoil.

6. The air cooled turbine rotor blade of claim 2, and further comprising:

the third leg of the third serpentine flow circuit is located along the leading edge region of the airfoil; and, the third leg of the fourth serpentine flow circuit is located along the trailing edge region of the airfoil.

7. The air cooled turbine rotor blade of claim 1, and further comprising:

the third and fourth multiple pass serpentine flow cooling circuits discharge the cooling air through blade tip cooling holes.

8. The air cooled turbine rotor blade of claim 1, and further comprising:

the air cooled turbine rotor blade is a low flow cooling circuit without trailing edge exit holes or film cooling holes on the pressure wall side or the suction wall side.

9. The air cooled turbine rotor blade of claim 1, and further comprising:

the first and third multiple pass serpentine flow cooling circuits are both aft flowing serpentine flow circuits; and, the second and fourth multiple pass serpentine flow cooling circuits are both forward flowing serpentine flow circuits.

10. A process for cooling a large industrial gas turbine engine rotor blade, the blade having a leading edge and a trailing edge with a pressure side wall and a suction side wall extending between the two edges, the blade having a lower span and an upper span, the process comprising the steps of:

cooling a forward section of the blade in the lower span with a first serpentine flow cooling circuit;

cooling an aft section of the blade in the lower span with a second serpentine flow cooling circuit;

cooling a forward section of the blade in the upper span with a third serpentine flow cooling circuit supplied with cooling air from the first serpentine flow cooling circuit; and, cooling an aft section of the blade in the upper span with a fourth serpentine flow cooling circuit supplied with cooling air from the second serpentine flow cooling circuit.

11. The process for cooling a large industrial gas turbine engine rotor blade of claim 10, and further comprising the step of:

passing the first serpentine flow cooling circuit in an aft flowing direction; and, passing the second serpentine flow cooling circuit in a forward flowing direction.

12. The process for cooling a large industrial gas turbine engine rotor blade of claim 10, and further comprising the step of:

discharging the cooling air from the third and fourth serpentine flow cooling circuits through blade tip cooling holes to cool the blade tip.

13. The process for cooling a large industrial gas turbine engine rotor blade of claim 10, and further comprising the step of:

passing all of the cooling air through the four serpentine flow cooling circuits without discharging cooling air through the trailing edge or as film cooling air on the pressure or suction side walls.

* * * * *